United States Patent [19]

Depp et al.

[11] 4,361,781

[45] Nov. 30, 1982

[54] MULTIPLE ELECTRON BEAM CATHODE RAY TUBE

[75] Inventors: Steven W. Depp, San Jose, Calif.; Bruce P. Piggin, Sherfield English, England

[73] Assignee: International Business Machines Corporation, Armonk, N.Y.

[21] Appl. No.: 148,899

[22] Filed: May 12, 1980

[51] Int. Cl.[3] ..... H01J 29/50; H01J 29/46

[52] U.S. Cl. ..... 313/409

[58] Field of Search ..... 313/409

[56] References Cited

U.S. PATENT DOCUMENTS

| | | | |
|---|---|---|---|
| 2,758,234 | 8/1956 | Hensel | 313/409 |
| 2,827,591 | 3/1958 | Bowie | 313/409 |
| 2,862,144 | 11/1958 | McNaney | 313/410 |
| 3,178,603 | 4/1965 | Moss | 313/410 |
| 3,340,419 | 9/1967 | Starr et al. | 313/409 |
| 3,740,603 | 6/1973 | Kuhn | 313/410 |
| 3,818,260 | 6/1974 | Elfe et al. | 313/299 |
| 3,935,500 | 1/1976 | Oess et al. | 313/495 |
| 3,978,364 | 8/1976 | Dimeff et al. | 313/250 X |
| 4,031,425 | 6/1977 | Ziegler et al. | 313/346 R |
| 4,091,306 | 5/1978 | Hant | 313/409 |
| 4,138,622 | 2/1979 | McCormick et al. | 313/306 |

*Primary Examiner*—Robert Segal

*Attorney, Agent, or Firm*—Joseph E. Kieninger

[57] ABSTRACT

A multiple electron beam cathode ray tube has a plurality of cathodes in a plane to form an array. Grids on the same substrate are positioned in spaced relation about the cathodes so that a plurality of individually controlled electron beams are formed when appropriate potentials are applied to the cathodes and grids.

7 Claims, 4 Drawing Figures

MULTIPLE ELECTRON BEAM CATHODE RAY TUBE

DESCRIPTION

1. Technical Field

This invention relates to a cathode ray tube (CRT) and more particularly to a CRT having a plurality of controlled electron beams.

It is a primary object of this invention to provide an improved CRT.

It is another object of this invention to provide a CRT with a plurality of electron beams.

It is still another object of this invention to provide a multiple electron beam CRT in which the electron beams can be individually modulated.

It is yet another object of this invention to provide a multiple electron beam CRT that can be batch-fabricated with photolithography to accurately define the distance between the cathode and the grid as well as the size of the cathode.

It is a further object of this invention to provide a CRT with an integrated mechanically stable structure.

It is a still further object of this invention to provide a CRT operative with small grid-to-cathode voltages and negligible grid currents.

2. Background Art

Multiple electron beam CRTs using a cathode array have a number of advantages over the conventional single beam CRT. Multiple electron beam CRTs have greater writing speed, use smaller beam currents and have less flicker than single beam CRTs. Multiple electron beam CRTs are described in the patent to Starr et al U.S. Pat. No. 3,340,419; to Oess et al U.S. Pat. No. 3,935,500; and to Hant U.S. Pat. No. 4,091,306. In all of these CRTS the cathode arrays are in a different plane from the plane of the grid, i.e., the cathodes and the grid are not coplanar and they are not on the same surface. While these patents describe multiple beam CRTs that have the aforementioned advantages, these devices suffer the disadvantage of containing many parts and being difficult to construct. In addition they have the added disadvantages of being fragile and subject to thermally induced changes in critical dimensions, e.g. the distance between cathode and grid.

In an analagous art dealing with a triode vacuum tube, the patent to McCormick et al U.S. 4,138,622 describes a single cathode-grid structure that is coplanar. However, the purpose of this coplanar structure which has only one cathode is only electronic gain and the device is not a CRT.

BRIEF DESCRIPTION OF THE DRAWINGS

In the accompanying drawings forming a material part of this disclosure.

DISCLOSURE OF THE INVENTION

For a further understanding of the invention and of the objects and advantages thereof, reference will be had to the following description and accompanying drawings, and to the appended claims in which the various novel features of the invention are more particularly set forth.

A multiple electron beam cathode ray tube has a plurality of cathodes in a plane positioned on one side of a substrate to form an array. Grids in the same plane, i.e. on the surface of the same substrate, are positioned in spaced relation about the cathodes. A heater is associated with the substrate for heating the cathodes. The resultant integrated structure is mechanically stable and operative with small grid-to-cathode voltages, for example, less than 35 volts, and negligible grid currents so that a plurality of individually controlled electron beams are formed when appropriate potentials are applied to the cathodes and grids. This structure can be batch-fabricated with photolithography to accurately define the distance between the cathode and the grid as well as the size of the cathode.

BEST MODE FOR CARRYING OUT THE INVENTION

Figure 1:
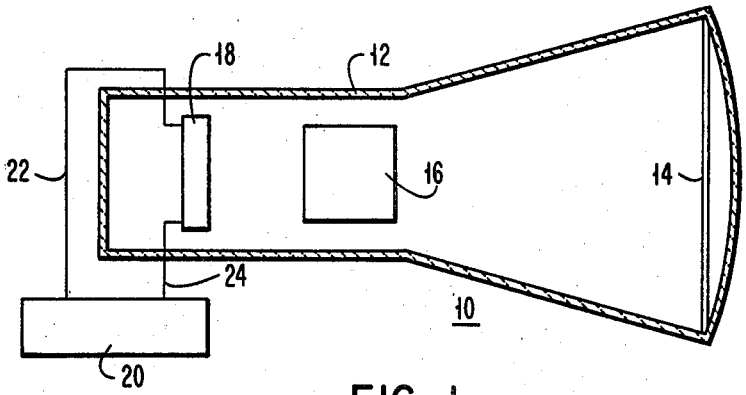
FIG. 1 illustrates a multiple electron beam CRT according to the present invention.

As shown in FIG. 1, the multiple electron beam cathode ray tube 10 has an envelope 12, fluorescent screen 14, means 16 for accelerating, focusing and deflecting electron beams, an integral structure 18 which is described in detail in connection with FIGS. 2 and 3 and which is situated in the neck portion of envelope 12. As schematically illustrated, the integral structure 18 is connected to a source 20 of electrical input signals by a plurality of wires 22 and 24.

Figure 2:
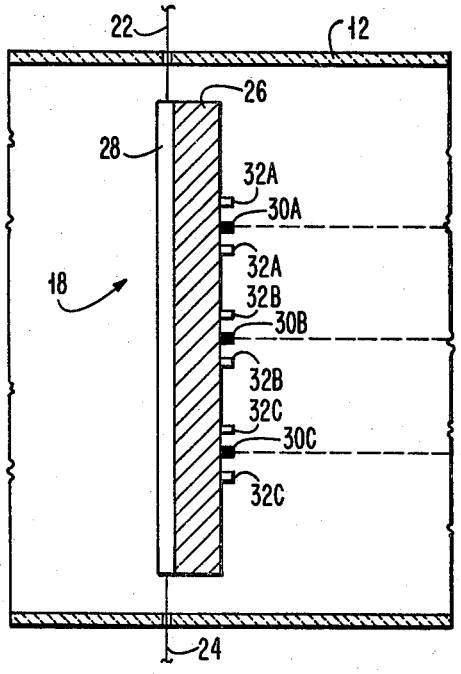
FIG. 2 is a fragmentary cross-sectional view showing one embodiment of an integral cathode array-grid structure portion of the device.

The integral assembly 18 is illustrated in detail in FIG. 2. The assembly 18 has a substrate 26 of a high temperature insulator with good thermal conductivity such as sapphire. On the back surface of the substrate 26 is a thin film heater 28 made from a resistive, refractory metal, such as tungsten or molybdenum. Positioned on the front surface of the substrate 26 are an array of cathodes 30A, B, C, that are surrounded by modulating grids 32A, B, C, respectively. In this embodiment the array of cathodes 30A–C and grids 32A–C are on the same surface which is in a single plane. The cathodes 30A–C and the grids 32A–C need to be on the same surface but it is not essential that the surface be planar. In other words, the cathodes 30A–C could be recessed with respect to the grids 32A–C. One of the wires from the plurality of wires 22 goes from the source 20 to the heater 28 and one of the wires 24, goes from the heater 28 to the source 20. The wires from wire bundles 22 and 24 which go to the cathode arrays 30A–C and to the grid areas 32A–C are not shown. The electrical connections to the cathode and grid are shown in FIG. 3.

The integral structure 18 can be batch-fabricated with photolithographic process steps. For example, the cathodes 30A through 30C and the modulating grid areas 32A through 32C are deposited on the front surface of substrate 28 as a thin film of molybdenum, tungsten, platinum or other suitable refractory material and then defined by conventional photolithographic techniques. The cathode areas are then made electron-emitting by delineating a mixture of photoresist and carbonates of strontium, barium and calcium in those regions. When the substrate is heated in a vacuum to a temperature of approximately 1000° C., the photoresist volatilizes leaving the cathodes 30A–C electron emitting and capable of being activated in the usual manner by applying the appropriate voltage. This batch fabrication method is capable of very fine dimensional control providing the capability of making cathode and grid lines as small as 10μ in width.

In operation the thin film heater 28 heats the substrate 26 to a temperature of the order of 700° C. so that sufficient electron emission takes place. The cathodes 30 would then be individually biased with respect to the grid electrode(s) 32 to either cut off or turn on. In an alternative embodiment, adjacent grid electrodes, for example, 32B and 32C, may be replaced by a single grid electrode.

Figure 3:
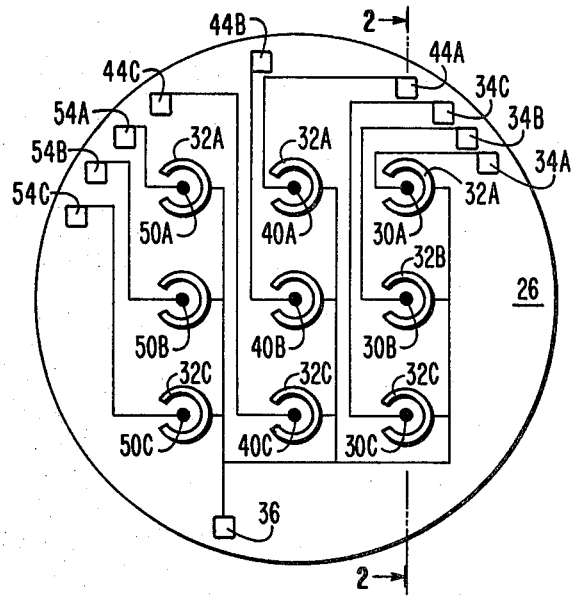
FIG. 3 is a top view of the electrical connections to the cathode array-grid structure of FIG. 2.

The electrical wiring to the cathodes and the grid is shown in FIG. 3. On the surface of the substrate 26 the electrodes 30A to 30C, 40A to 40C and 50A to 50C, are connected to bonding pads 34A–C, 44A–C and 54A–C respectively. This permits each one of the electrodes to be individually controlled. The grids 32A, 32B and 32C are all connected to the grid bonding pad 36 thereby resulting in a potential to the grid which is constant. Another embodiment of this invention would have the grids individually connected to separate bonding pads so that the potential to each grid could be individually controlled. The essential feature to this invention is to individually modulate the potentials between each cathode and the grid immediately surrounding that cathode. This may be done by maintaining the grid constant and individually controlling the cathode potentials as shown in FIG. 3, or by maintaining the cathode potential constant and individually varying the grids, or by individually controlling the potential of each cathode and the potential of each grid.

Figure 4:
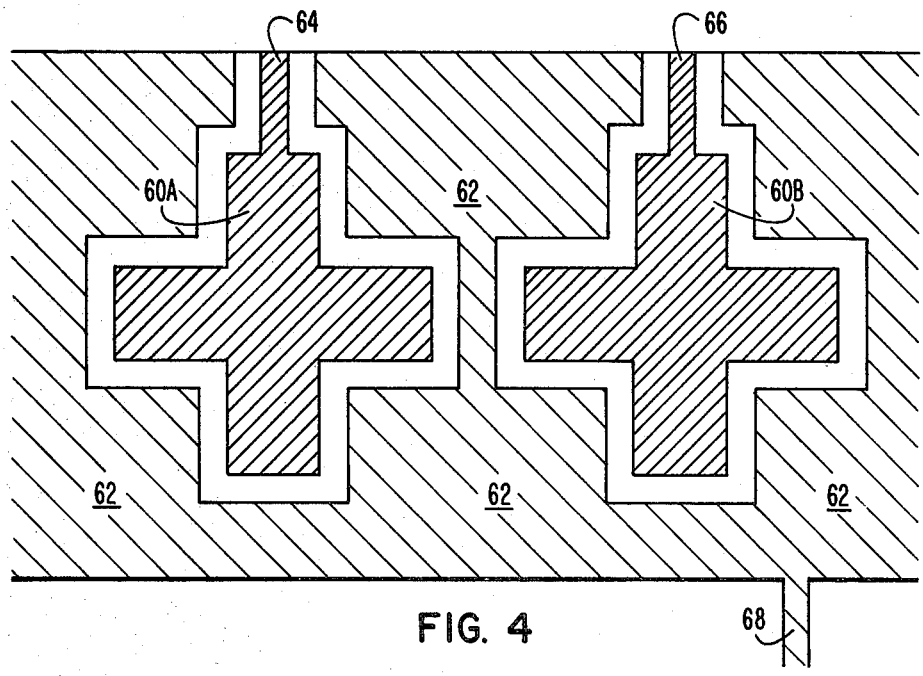
FIG. 4 is a top view of a second embodiment of a cathode-grid structure.

While the configuration of the grid in FIG. 3 is in the shape of a C that surrounds a circular cathode, another embodiment or geometry of a grid-cathode design is shown in FIG. 4. The cathodes 60A and B are in the form of a cross and the grid 62 surrounds the cathodes 60A and B as shown. Wires 64 and 66 are connected to the cathodes 60A and B and the grid is connected to wire 68.

The geometry illustrated in FIGS. 1 through 4 and the method of fabrication have a number of advantages. The use of photolithography defines the critical dimensions between the cathode and the grid which determine the electron gain as well as providing high resolution cathodes. The small grid-cathode spacing achievable with photolithography gives a large transconductance and small grid-to-cathode voltages. The coplanar grid provides a rugged construction with no microphonics and with very little if any grid current. The cathode/grids and heaters are fabricated as one integrated assembly which is a mechanically stable structure. In addition, the use of photolithography allows many cathode-grid arrays to be fabricated at the same time thereby resulting in a substantially lower cost per unit.

While we have illustrated and described the preferred embodiment of our invention, it is understood that we do not limit ourselves to the precise constructions herein disclosed and the right is reserved to all changes and modifications coming within the scope of the invention as defined in the appended claims.

We claim:

1. An integral structure for use in a cathode ray tube having a fluorescent screen device comprising:

an electrically insulating substrate, a plurality of cathodes on said substrate to form an array, a heater associated with said substrate for heating said cathodes and a plurality of grids on said substrate positioned in spaced relation around and individually surrounding said cathoder said cathodes so as to be substantially coplanar therewith wherein a plurality of individually controllable electron beams are formed which would subsequently strike the screen when appropriate potentials are applied to said cathodes and grids.

2. A structure as defined in claim 1 wherein the heater is positioned on the first side of the substrate and the cathode is positioned on the second side of the substrate.

3. A structure as defined in claim 1 including electrical means connected individually to said cathodes and said grids.

4. A structure as defined in claim 3 wherein said electrical means individually modulates the potentials between said grids and said cathodes.

5. A structure as defined in claim 3 wherein the electrical means provides a constant potential to said grids.

6. A structure as defined in claim 3 wherein the electrical means provides a constant potential to said cathodes.

7. A structure as defined in claim 3 wherein said electrical means passes through said insulator.

* * * * *